United States Patent [19]

Hunter

[11] 4,146,819

[45] Mar. 27, 1979

[54] METHOD FOR VARYING VOLTAGE IN A HIGH INTENSITY DISCHARGE MERCURY LAMP

[75] Inventor: Donald W. Hunter, Indianapolis, Ind.

[73] Assignee: Union Carbide Corporation, New York, N.Y.

[21] Appl. No.: 828,721

[22] Filed: Aug. 29, 1977

[51] Int. Cl.[2] ..... H05B 41/36

[52] U.S. Cl. ..... 315/117; 313/13; 315/307

[58] Field of Search ..... 315/112, 117, 291, 307, 315/309, DIG. 4; 313/13, 44; 323/3

[56] References Cited

U.S. PATENT DOCUMENTS

| | | | |
|---|---|---|---|
| 2,080,908 | 5/1937 | Bunger et al. | 315/117 |
| 2,279,941 | 4/1942 | Dunham et al. | 315/117 |

*Primary Examiner*—Eugene R. LaRoche
*Attorney, Agent, or Firm*—Saul R. Bresch

[57] ABSTRACT

A method for varying the voltage in a high intensity discharge mercury lamp comprising the following steps:

(a) energizing the lamp at a substantially fixed current;

(b) selecting a predetermined voltage;

(c) sensing the lamp voltage; and (d) when the lamp voltage rises above the predetermined voltage, directing a pulsed flow of gas, which gas is at a temperature sufficient to condense the mercury, against the outer surface of the lamp intermediate of its electrodes at a pulse rate and pulse duration sufficient to achieve and maintain about the predetermined voltage.

3 Claims, 7 Drawing Figures

METHOD FOR VARYING VOLTAGE IN A HIGH INTENSITY DISCHARGE MERCURY LAMP

FIELD OF THE INVENTION

This invention relates to a method for varying voltage particularly in high intensity discharge mercury lamps.

DESCRIPTION OF THE PRIOR ART

High intensity discharge mercury lamps are commonly used in photocuring and other areas where relatively inexpensive and efficient generators of electromagnetic radiation in the ultraviolet wave range are needed.

A typical lamp comprises an elongated fused quartz envelope or tube with two ends; on each end there is a metal electrode attached to the tube with a quartz to metal seal. Inside the tube there are a small amount of mercury and an inert gas such as argon. The lamp is powered by a ballast, most of the commercially available ballasts providing a substantially fixed current level.

A typical ballast is a step-up transformer of the flux leakage, constant wattage type with a capacitor connected in series with the lamp. The ballast is designed to hold lamp current within ± 5 percent with input power fluctuations of ± 20 percent, and with a high secondary reactance and with 50 percent greater open circuit voltage than operating voltage.

At the beginning of operation of the lamp, the vapor density or internal lamp pressure increases as the voltage increases to full potential. At this point of maximum potential, if the lamp is extinguished, several minutes are required before the lamp can be restarted. This is due to the high potential required to start the lamp at high mercury vapor densities or high internal pressures. To shorten the starting time, it was suggested that the lamp be cooled externally thus causing the ionized mercury to condense and lowering the internal lamp pressure. If was found that this cooling of the lamp not only lowered the operating voltage of the device, but lowered the potential required to restart the lamp, and that the lower the required potential the faster the lamp could be restarted. Cooling for this purpose was usually accomplished with a fan which blew cold air against the lamp, preferably the coolest spot on the quartz envelope. Another advantage of cooling was to maintain the temperature of the lamp at its most efficient level.

While the advantages of quick restart and efficient temperature levels are of value, it became apparent that the proposed form of cooling was only advantageous at the extreme ends of the voltage spectrum, and that a hiatus remained, i.e., there was no simple means for controlling potential at desired levels between zero and maximum during operation. It was also apparent that achieving such control was complicated by a fact that had been already taken advantage of in the above-described cooling process, such fact being that the mercury in the lamp exists in only two states: the condensed state or the vaporized state. This means that the mercury does not want to stabilize at any point other than at all condensed (at start-up potential) or at all vaporized (full potential).

SUMMARY OF THE INVENTION

An object of this invention, therefore, is to provide a method for varying the voltage of high intensity discharge mercury lamps, the state of the mercury notwithstanding, with the result being that a desired voltage level will be maintained indefinitely.

Other objects and advantages will become apparent hereinafter.

According to the present invention, a method has been discovered whereby the voltage can be varied or controlled in a high intensity discharge mercury lamp to such an extent that a desired voltage level can be maintained indefinitely.

The method comprises the following steps:

(a) energizing the lamp at a substantially fixed current;

(b) selecting a predetermined voltage;

(c) sensing the lamp voltage; and (d) when the lamp voltage rises above the predetermined voltage, directing a pulsed flow of gas, which gas is at a temperature sufficient to condense the mercury, against the outer surface of the lamp intermediate of its electrodes at a pulse rate and pulse duration sufficient to achieve and maintain about the predetermined voltage.

DESCRIPTION OF THE PREFERRED EMBODIMENT

Figure 1:
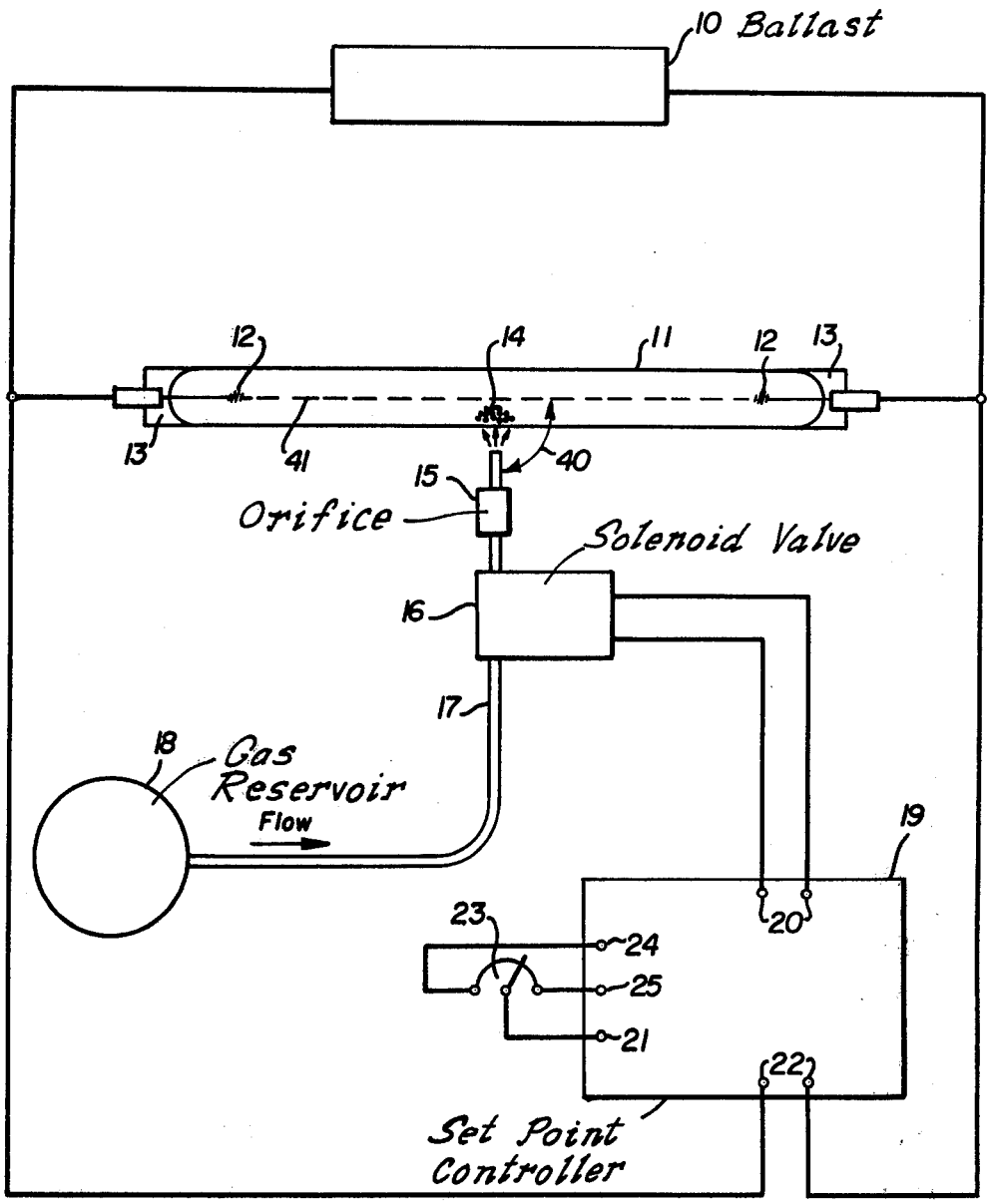
FIG. 1 is a schematic diagram of apparatus including ballast, lamp, one example of gas delivery means, and automatic controller capable of carrying out the invention.

The high intensity discharge mercury lamp to be utilized in the method of this invention has been described above in general terms and is quite conventional.

Preferably, it is a high pressure or medium pressure mercury lamp charged with mercury and an inert gas at the factory and capable of operating at a predetermined point. This point is set at the factory by adjusting the inert gas pressure and the quantity of mercury. Within limits, a lamp is almost a constant voltage device once it has attained its designed maximum potential, and it has been observed that the voltage stays within 15 percent of its normal operating level even when the current is changed from 60 percent below to 50 percent above normal current levels. This observation is based on the ability of the arc to keep all of the mercury vaporized and to maintain a constant envelope temperature. Any particular lamp has the following fixed parameters: arc length, tube or envelope diameter, quantity of mercury (or other additions to the tube), and initial pressure.

Examples of various lamps which meet the description are as follows:

Voltare UV-LUX H25C/12A, H5OC/25A H22C/24B, H44C/48B

Western Quartz Products 12-20004-E, 24-20008-E
Conrad Hanovia 6512A431, 6525A431
Sylvania H5KW25, H2200T4/24
Illumination Industries J231218B, J232531B For all practical purposes, the previously described ballast serves three functions. It provides sufficient series impedance to limit current; it provides enough voltage to strike and maintain the arc; and it stabilizes the current through the start and run cycles for variations in input line voltage.

Examples of various ballasts which meet the description are as follows:

Shape Magnetronics W2556, W1669, W3329,
Micron Industries FNH22BT, FNHX96BT, FNH50BT
Jefferson Electric Co. 13849Q331, 13883Q331

The lamp in step (a) is energized at a substantially fixed current level whereby the voltage progressively increases towards the highest voltage level attainable by the lamp. This is accomplished by presentation of sufficient voltage to strike the arc; and controlling the current by means of the ballast, which maintains the current within ± ten percent from the starting mode through the operating mode. A typical cold lamp voltage-time curve instantaneously starts off at about full potential, drops off 80 or 90 percent, and then progressively recovers to within about minus ten percent of full potential within two to five minutes. Time in the voltage-time curve is determined by ambient temperature, current, and the characteristics of the lamp.

In step (b), a desired voltage is selected, predetermined, of course, by the needs of the particular operation in which the lamp is used. In step (c), the lamp voltage is sensed as it progresses towards or arrives at full potential. The process steps are all preferably carried out in a fully automated fashion and when the sensed lamp voltage is at a higher level than the set point for the desired voltage, the pulsed flow of gas is triggered and step (c) proceeds. First the pulse rate and pulse duration are such that the voltage is driven down to achieve about the predetermined voltage and then the pulse rate and pulse duration go into a maintenance mode which holds the voltage at about the set point or predetermined voltage level.

At any point along the path through full potential, a pulsed flow of gas is directed against the lamp as described. The term "pulsed" simply means that an alternating on-off flow of gas is used.

The gas is not essentially permitted to contact the ends of the lamp where the electrodes reside and the quartz to metal seal is located because cooling in this area inhibits effective voltage control.

It is preferred that the flow or stream of gas be "well-spread" over the surface of the lamp. The center portion of the arc appears to be the best location at which to begin the flow. The gas injector or nozzle, both of which are conventional, is generally placed at about 0.25 to about 2 inches from the lamp. The gas can also be "directed" to a particular point on the lamp, and it is found that with this type of operation, the change in voltage can be accomplished faster than with the well-spread form of operation; however, the well-spread procedure is capable of varying the voltage over a wider range. A fan, small pump, or recirculator can be used to deliver the gas.

Each "pulse" can be considered to be one flow or burst of gas given when the gas delivery means is in the "on" mode, i.e., the gas is permitted to flow. The length of time for each pulse referred to as "pulse duration" is generally about 1 second to about 10 seconds and is preferably less than about 5 seconds. The "pulse rate" is the number of pulses per minute and can generally be about 6 to about 60 pulses per minute and is preferably less than about 20 pulses per minute. In between the pulses the gas delivery means is in the "off" mode, i.e., the gas is not permitted to flow. The ratio of length of time for the pulse or "on" mode to the length of time for the "off" mode is generally about 0.1:1 to about 3:1 and is preferably less than about 1:1. The specific pulse duration and pulse rate are determined automatically by the set point controller relative to the operational parameters of the specific lamp used.

The rate of flow of the gas per kilowatt of lamp input power during the "on" mode is generally about 5 standard cubic feet per hour (scfh) per kilowatt to about 50 scfh per kilowatt and preferably about 10 scfh to about 15 scfh per kilowatt.

The temperature of the gas is sufficient to bring the voltage to a point at or below the desired voltage level. The flow of gas is initiated when the voltage is higher than the desired level and the temperature of the gas is such that it will condense mercury vapor. The temperature will generally be in the range of about 0° C. to about 50° C. and is preferably about 15° C. to about 30° C. An advantage of this invention is that the rate of flow and the temperature are not critical and the desired voltage level is achieved and maintained by the set point controller, which automatically adjusts the pulse duration and pulse rate of the gas. This method is desirable because typical lamps with no external cooling operate over temperatures in the range of about 600 degrees C. to about 800 degrees C. Further, each lamp has different heat transfer characteristics. Therefore, pulse duration and pulse rate have to be adjusted accordingly within the generally prescribed ranges to provide the desired voltage level for each specific lamp's parameters.

Any gas substantially inert to the lamp components and its external environment can be used. Examples are nitrogen and air with nitrogen being preferred.

Operational characteristics have been indentified for the invention relative to its ability to vary voltage. While the upper limit of voltage variation is the full potential of the lamp, the lower limit which can be reached by the variable control provided by subject process is about 7.5 percent above zero potential using the well-spread gas flow alluded to above, e.g., it is observed that using the well spread flow in a particular lamp, the voltage can be varied from 100 percent to 7.5 percent while with the directed flow the voltage in the same lamp can only be varied from 100 percent to 12 percent. Another characteristic is the tendency for the voltage to oscillate about the desired voltage level, after the nominal set point has been reached, by about 0.5 to about 2 percent. Finally, it is found to be critical that each lamp be controlled individually rather than in groups although the same basic controller can be used.

Referring to the drawing:

In FIG. 1, ballast 10 provides a constant current power supply to lamp 11. Gas is maintained in gas reservoir 18 and in line 17 up to solenoid valve 16, which is in a normally closed state. On a signal from set point controller 19, solenoid valve 16 opens and the gas continues along gas line 17 through orifice 15 where it is "directed" to a point on lamp 11 causing the occurrence of condensed mercury 14 (the arrows indicate direction of gas flow.) The function of orifice 15 is to measurably control the flow rate for a given supply pressure. The pulse rate and pulse duration are controlled by controller 19, i.e., the opening and closing of solenoid valve 16, and the length of time it is kept open and kept closed. The signal from controller 19 is delivered to terminals 20 for delivery to solenoid valve 16. The desired voltage level or set point is set by adjusting variable resistor 23 which is connected to a low voltage, direct current power source (not shown) through terminal 24, ground (not shown) through terminal 25, and an integrated circuit voltage comparator (not shown) through terminal 21. The potential input from lamp 11 to controller 19 enters at terminals 22. It will be observed that the gas is delivered intermediate of electrodes 12 and also quartz to metal seals 13. The temperature of the gas, the flow rate and the desired voltage level are preset and the controller determines the pulse rate and length of pulse time required to obtain the desired voltage level and controls the opening and the closing of the solenoid valve accordingly. The angle 40 in FIG. 1 is preferably from about 30 degrees to about 150 degrees in relation to theoretical lamp axis 41 for efficient operation.

Figure 2:
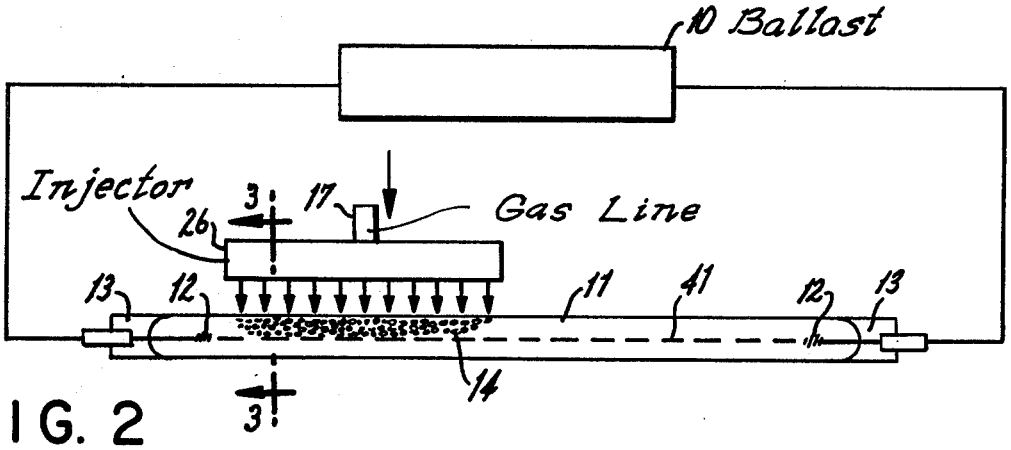
FIG. 2 is a schematic diagram of apparatus exclusive of controller but including ballast, lamp, and another example of gas delivery means.

FIG. 2 is similar to FIG. 1 in that it shows ballast 10, lamp 11, electrodes 12, quartz to metal seals 13, gas line 17, and condensed mercury 14. Instead of the gas delivery of FIG. 1 directly through gas line 17 to a point on lamp 11, FIG. 2 shows gas line 17 feeding into injector 26 which directs the gas in the plane of lamp axis 41 and at several points along lamp axis 41. This injector could run the length of the lamp or be located anywhere along the lamp provided the injection of gas takes place intermediate of electrodes 12. This is an example of "well-spread" gas delivery. It is preferred that the plane of gas delivery or impingement on the lamp contains the longitudinal lamp axis 41 and that the orifices of the injector are closely spaced or a continuous channel is used because random gas injection is inefficient.

Figure 3:
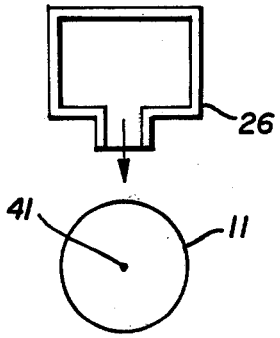
FIG. 3 is a schematic diagram of a cross-section taken along lines 3—3 of FIG. 2.

FIG. 3 is a cross-section of FIG. 2 taken along line 3—3, and it shows the impingement on lamp 11 of the gas directed in the plane of lamp axis 41 from injector 26 through an orifice or channel.

Figure 4:
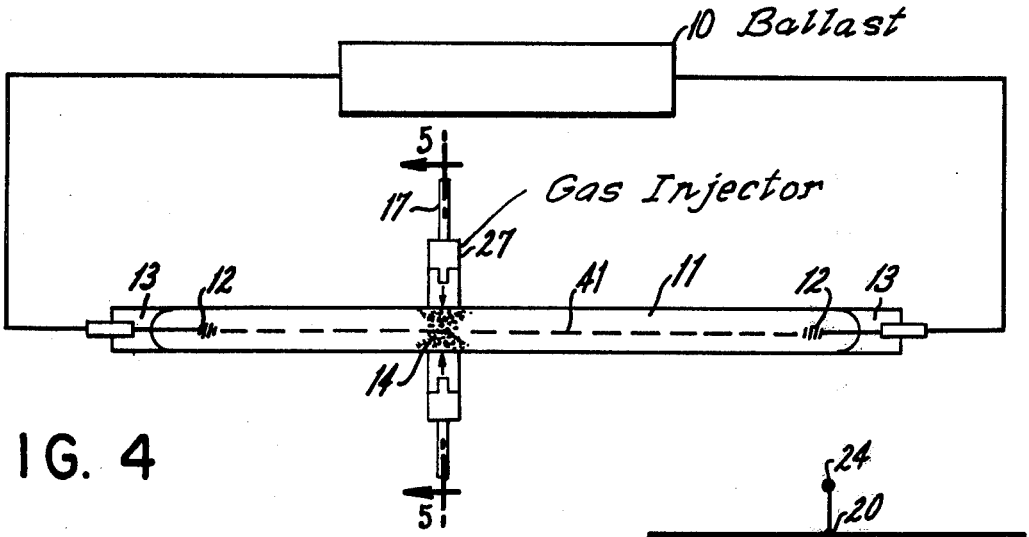
FIG. 4 is a schematic diagram similar to FIG. 2 except that still another example of gas delivery means is shown.

FIG. 4 is also similar to FIG. 1 in that ballast 10, lamp 11, electrodes 12, quartz to metal seals 13, gas line 17, and condensed mercury 14 are shown. The purpose of this figure is to illustrate another and more preferred "well-spread" means for delivery of the gas although it is difficult to manufacture. In this case gas injector 27 is a circular manifold with orifices or a channel surrounding lamp 11. The gas stream or the channelled gas is directed at the lamp at a 90 degree angle to lamp axis 41. Whether orifices, channels, or nozzles are used in FIGS. 3 and 4, it will be understood that they are to be constructed so that the gas will impinge on the tube of lamp 11 at the desired angle.

Figure 5:
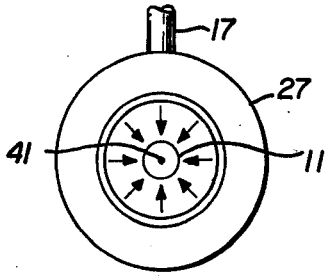
FIG. 5 is a schematic diagram of a cross-section taken along lines 5—5 of FIG. 4.

FIG. 5 is a cross-section of FIG. 4 taken along line 5—5. It shows circular gas injector 27 with its gas streams impinging on lamp 11 at 90 degrees to lamp axis 41.

Figure 6:
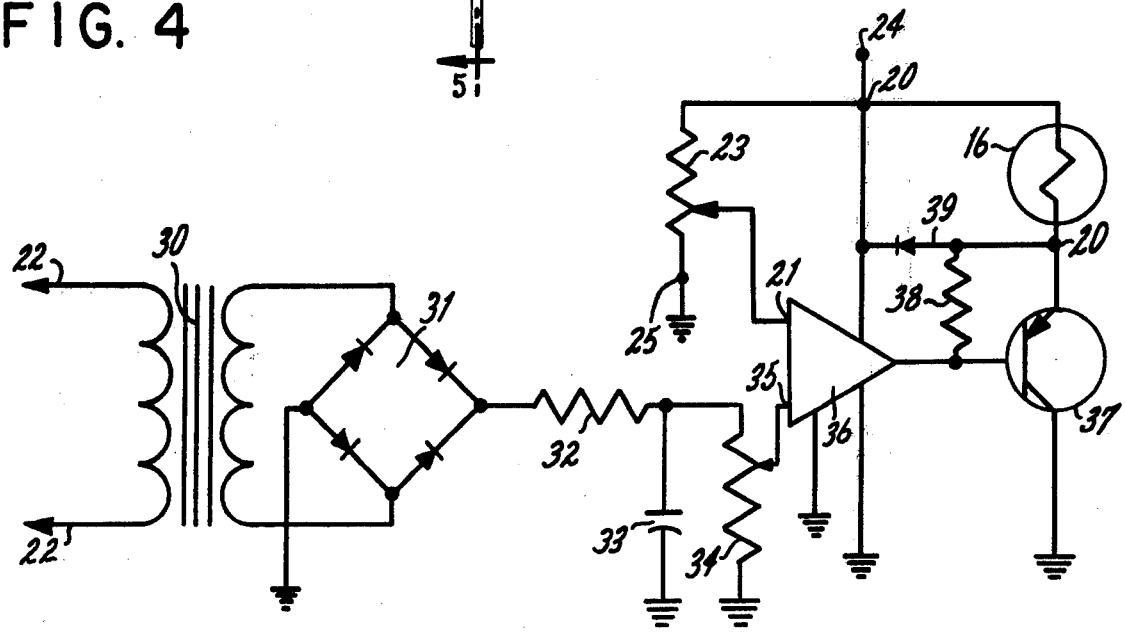
FIG. 6 illustrates circuitry which can be used for controller 19 in FIG. 1.

It will be understood by those skilled in the art that controller 19 in FIG. 1 can take many forms ranging from the simple to the very sophisticated. FIG. 6 illustrates the circuitry for a controller whereby the same basic circuit can be used for a multiplicity of lamps. The particular controller of FIG. 6 both senses and controls voltage. An alternative mode could use a photoconductive or photovoltaic cell to sense radiation from the lamp, then convert the signal to voltage, and, of course, control the voltage. Examples of other forms controller 19 can take are as follows:

Magnetic Meter Relay Controller;
Optical Meter Relay Controller; and
Microprocessor, signals converted to digital form.

In FIG. 6, the voltage input (from lamp 11 in FIG. 1) is received at terminals 22 where it passes into step down potential transformer 30. Here the voltage is reduced to a voltage that the controller can handle. The signal is then passed through bridge 31, which is made up of four diodes, where the alternating current is converted to full wave rectified direct current. From bridge 31, the signal passes through resistor 32, e.g., 200 ohms and capacitor 33, e.g., 100 microfarads, to steady the signal, which then enters variable resistor 34, e.g., 20 kiloohms. The function of variable resistor 34 is to make the now steady signal correctly proportional to the lamp voltage. The signal now moves to terminal 35 of integrated circuit voltage comparator 36, which compares this signal with the desired voltage level or set point signal feeding in from variable resistor 23, e.g., 20 kiloohms, through terminal 21. The comparator biases transistor 37 on wherever the voltage on terminal 35 exceeds the reference on terminal 21. The power supply for this operation (e.g., 24 volts, direct current) is received from terminal 24 through terminal 20. The power supply is not shown. In FIG. 1, terminal 24 and terminal 20 are not shown to be connected and may or may not be as desired. The signal from the comparator then passes to power switching transistor 37 along a path biased by resistor 38, e.g., 2.2 kiloohms, which crosses over into diode 39. The function of diode 39 is to absorb the inductive kick-back from solenoid valve 16. Transistor 37 sinks the potential on solenoid valve 16 to complete the circuit whenever comparator 36 biases it to the "on" mode. The pulse rate and duration of the pulse is therefore automatically set by the interaction of the lamp characteristics and the controller characteristics.

Figure 7:
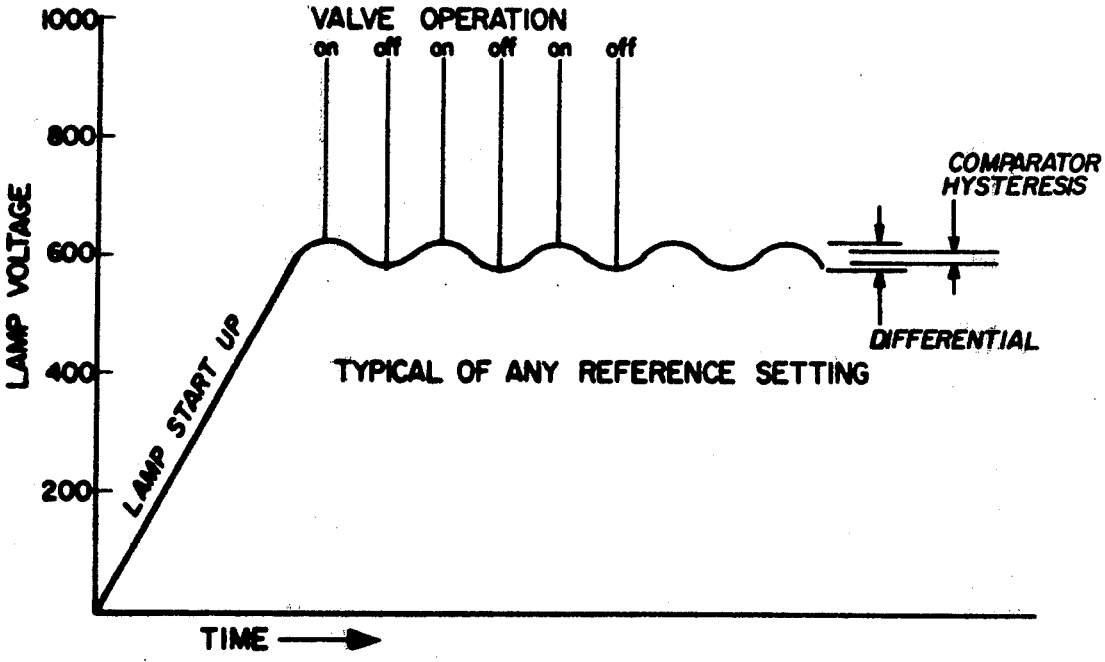
FIG. 7 shows a curve illustrating the operation of the invention where the desired voltage level is 600 volts.

FIG. 7 is a curve illustrating the operation of the invention in terms of a desired voltage level or set point of 600 volts. The X-axis represents time and the Y-axis lamp voltage. Once the lamp has started up and achieved 600 volts, the curve becomes gently undulating. The differential shown by the comparator hysteresis reflects a plus or minus deviation of about 0.5 to about 2 percent. The illustrated curve is typical of any set point subject to the low voltage limitation noted above.

It is found that varying current to achieve variable light output in high intensity lamps has many serious flaws, e.g., limited range of control (30 percent to 100 percent); relatively wide oscillation; and declining power factor with reduced power. Varying the lamp voltage according to subject invention has none of these infirmities. The power factor is as good as the ballast design at all power points making the invention a most efficient method of varying lamp output.

I claim:

1. A method for varying the voltage in a high intensity discharge mercury lamp comprising the following steps:

(a) energizing the lamp at a substantially fixed current;
(b) selecting a predetermined voltage;
(c) sensing the lamp voltage; and
(d) when the lamp voltage rises above the predetermined voltage, directing a pulsed flow of gas, which gas is at a temperature sufficient to condense the mercury, against the outer surface of the lamp intermediate of its electrodes at a pulse rate and pulse duration sufficient to achieve and maintain about the predetermined voltage.

2. The process defined in claim 1 wherein the flow of gas is well-spread.

3. The process defined in claim 1 wherein the flow of gas is directed.

* * * * *